US012215579B1

(12) United States Patent
Cochran

(10) Patent No.: US 12,215,579 B1
(45) Date of Patent: Feb. 4, 2025

(54) WELL INITIATION SERVICE SYSTEM WITH PACKER CONTROL SYSTEM

(71) Applicant: SAUDI ARABIAN OIL COMPANY, Dhahran (SA)

(72) Inventor: Jamie Cochran, Aberdeenshire (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/477,506

(22) Filed: Sep. 28, 2023

(51) Int. Cl.
*E21B 43/12* (2006.01)
*E21B 23/06* (2006.01)
*E21B 47/008* (2012.01)

(52) U.S. Cl.
CPC ..... *E21B 43/128* (2013.01); *E21B 23/06* (2013.01); *E21B 47/008* (2020.05)

(58) Field of Classification Search
CPC ..... E21B 43/128; E21B 23/06; E21B 47/008
See application file for complete search history.

(56) References Cited

U.S. PATENT DOCUMENTS 2,604,945 A * 7/1952 Page ..... E21B 23/01 417/450
6,568,475 B1 * 5/2003 Grubb ..... F04D 13/10 166/305.1
7,055,595 B2 * 6/2006 Mack ..... E21B 33/1275 166/387
8,770,271 B2 * 7/2014 Fielder ..... E21B 43/128 166/66.4
10,024,133 B2 7/2018 Symms
(Continued)

FOREIGN PATENT DOCUMENTS

GB 2451767 * 11/2008
WO 2022106704 A1 5/2022

OTHER PUBLICATIONS

O. G. Holloway et al., "Design and Operation of a Borehole Straddle Packer for Ground-Water Sampling and Hydraulic Testing of Discrete Intervals at U.S. Air Force Plant 6, Marietta, Georgia", U.S. Department of the Interior, U.S. Geological Survey, 2008 (32 pages).
(Continued)

*Primary Examiner* — D. Andrews
(74) *Attorney, Agent, or Firm* — Osha Bergman Watanabe & Burton LLP

(57) ABSTRACT

System and method for a bottom hole assembly (BHA) in production tubing including an electrical submersible pump (ESP), multi-resettable packer assembly, sensor, power and communications bus, and control system. The multi-resettable packer assembly includes a multi-resettable packer, a port sub hydraulically connecting production tubing to the ESP, an inner mandrel inside the multi-resettable packer axially movable within the multi-resettable packer and port sub, and a stroker tool configured to compress and decompress the multi-resettable packer to seal and unseal an inner surface of production tubing. The stroker tool includes slips to grip the inner surface and a piston that extends from and retracts into the stroker tool. The sensor is configured to measure operating data including a pressure measurement. The power and communications bus powers and transmits signals to the BHA. The control system monitors operating data and controls the stroker tool via the power and communications bus.

20 Claims, 10 Drawing Sheets

(56) References Cited

U.S. PATENT DOCUMENTS

| | | | | |
|---|---|---|---|---|
| 10,544,648 | B2 | 1/2020 | Costa De Oliveira et al. | |
| 10,662,750 | B2 | 5/2020 | Angman et al. | |
| 11,208,865 | B2 | 12/2021 | Hazel | |
| 11,851,974 | B1 * | 12/2023 | Ejim | E21B 34/14 |
| 2002/0074116 | A1 | 6/2002 | Millar et al. | |
| 2010/0089587 | A1 | 4/2010 | Stout | |
| 2012/0067564 | A1 | 3/2012 | Mack et al. | |
| 2014/0374119 | A1 | 12/2014 | Dewars et al. | |
| 2016/0061010 | A1 * | 3/2016 | Sears | E21B 43/128 166/66.4 |
| 2018/0087347 | A1 | 3/2018 | Rochen et al. | |
| 2022/0025751 | A1 | 1/2022 | Wensrich et al. | |
| 2022/0098956 | A1 | 3/2022 | Angman et al. | |
| 2022/0195852 | A1 | 6/2022 | O'Malley | |
| 2022/0213886 | A1 | 7/2022 | Al-Gouhi | |

OTHER PUBLICATIONS

C. Wrighton et al., "A Novel Technique to Revive Killed Wells Back into Production", International Petroleum Technology Conference, IPTC-20196-Abstract, Jan. 13, 2020, pp. 1-16 (16 pages).

International Search Report issued for corresponding international patent application No. PCT/US2024/048291, mailed Nov. 12, 2024 (5 pages).

Written Opinion issued for corresponding international patent application No. PCT/US2024/048291, mailed Nov. 12, 2024 (8 pages).

* cited by examiner

WELL INITIATION SERVICE SYSTEM WITH PACKER CONTROL SYSTEM

BACKGROUND

In hydrocarbon well development, it is common practice to use electrical submersible pumping systems (ESPs) as a primary form of artificial lift. ESP operations may require unloading for initiating natural production flow on wells that have been killed with a workover fluid. The unloading process includes removing the column of kill fluid from the well. Unloading is commonly performed using coiled tubing to circulate nitrogen into the well at a deep injection point to induce flow by lightening the fluid column. An alternative method for unloading includes using a slimline through-tubing ESP with less surface equipment.

Consequently, coiled tubing nitrogen pumping is time consuming and requires complex logics. The challenges of the existing slimline through-tubing ESP systems include setting and unsetting the packer system multiple times. Setting a packer with wireline in a wellbore is typically achieved using a setting tool for setting slips and a sealing element concurrently. The setting tools are single use items that require redress at surface. A redress requires tripping the setting tool out of the hole. Tripping the setting tool out of hole results in a reduction of operation efficiency. Furthermore, large temperature changes commonly experienced in unloading jobs are outside of the working range of the ESP system. Significant amounts of solids debris and different fluid viscosities are expected to flow through the ESP over the operation duration. Unloading operations have not been available in high hydrogen sulfide (H2S) wells due to high current requirements.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a bottom hole assembly (BHA) deployable in a production tubing, the BHA comprising: an electrical submersible pump (ESP) having an outer diameter smaller than an inner diameter of the production tubing; and a multi-resettable packer assembly, the multi-resettable packer assembly comprising: a first multi-resettable packer having a first packer ring and a second packer ring; a port sub coupled below the first packer ring on the first multi-resettable packer, wherein the port sub is configured to hydraulically connect the production tubing to the ESP; an inner mandrel disposed inside the first multi-resettable packer and axially movable within the first multi-resettable packer and the port sub, the inner mandrel having a first end and a second end, the second end coupled to the second packer ring on the first multi-resettable packer, the inner mandrel having at least one intake port proximate the first end configured to allow fluid from outside the inner mandrel to an inner bore of the inner mandrel; and a stroker tool configured to compress and decompress the first multi-resettable packer to seal and unseal, respectively, against an inner surface of the production tubing, the stroker tool comprising a plurality of slips configured to grip the inner surface and a piston configured to extend from and retract into the stroker tool, wherein an end of the piston is coupled to the first end of the inner mandrel.

In one aspect, embodiments disclosed herein relate to a system for initiating or logging natural flow in a production tubing, the system comprising: a bottom hole assembly (BHA) disposed in the production tubing, the BHA comprising: an electrical submersible pump (ESP) having an outer diameter smaller than an inner diameter of the production tubing; and a multi-resettable packer assembly coupled to the ESP, the multi-resettable packer assembly comprising: a first multi-resettable packer having a first packer ring and a second packer ring; a port sub coupled below the first packer ring on the first multi-resettable packer, wherein the port sub is configured to hydraulically connect the production tubing to the ESP; an inner mandrel disposed inside the first multi-resettable packer and axially movable within the first multi-resettable packer and the port sub, the inner mandrel having a first end and a second end, the second end coupled to the second packer ring on the first multi-resettable packer, the inner mandrel having at least one intake port proximate the first end configured to allow fluid from outside the inner mandrel to an inner bore of the inner mandrel; and a stroker tool configured to compress and decompress the first multi-resettable packer to seal and unseal, respectively, against an inner surface of the production tubing, the stroker tool comprising a plurality of slips configured to grip the inner surface and a piston configured to extend from and retract into the stroker tool, wherein an end of the piston is coupled to the first end of the inner mandrel; and a sensor disposed on the BHA configured to measure operating data, the operating data comprising a pressure measurement; a power and communications bus configured to power and transmit a signal to the BHA, the power and communications bus extending from the ESP to the stroker tool; and a control system configured to monitor the operating data measured by the sensor and control the stroker tool via the power and communications bus.

In one aspect, embodiments disclosed herein relate to a method for initiating or logging natural flow in a production tubing, the method comprising: conveying a bottom hole assembly (BHA) on a wireline to a predetermined depth into the production tubing, the BHA comprising: an electrical submersible pump (ESP) having an outer diameter smaller than an inner diameter of the production tubing; and a multi-resettable packer assembly, the multi-resettable packer assembly comprising: a first multi-resettable packer having a first packer ring and a second packer ring; a port sub coupled below the first packer ring on the first multi-resettable packer, wherein the port sub is configured to hydraulically connect the production tubing to the ESP; an inner mandrel disposed inside the first multi-resettable packer and axially movable within the first multi-resettable packer and the port sub, the inner mandrel having a first end and a second end, the second end coupled to the second packer ring on the first multi-resettable packer, the inner mandrel having at least one intake port proximate the first end configured to allow fluid from outside the inner mandrel to an inner bore of the inner mandrel; and a stroker tool configured to compress and decompress the first multi-resettable packer to seal and unseal, respectively, against an inner surface of the production tubing, the stroker tool comprising a plurality of slips configured to grip the inner surface and a piston configured to extend from and retract into the stroker tool, wherein an end of the piston is coupled to the first end of the inner mandrel; and operating data by a control system via a sensor disposed on the BHA configured to measure operating data, the operating data comprising a pressure measurement; compressing the first multi-resettable packer by retracting the piston into the stroker tool in response to a first signal sent by the control system based, at least in part, on the received operating data through a power and communications bus configured to power and transmit the first signal to the BHA, the compressing the first multi-resettable packer comprising forming a seal between the BHA and the inner surface of the production tubing; and decompressing the first multi-resettable packer by extending the piston out of the stroker tool and into the port sub in response to a second signal sent by the control system based, at least in part, on the received operating data, the decompressing the first multi-resettable packer comprising releasing the seal between the BHA and the inner surface of the production tubing.

Other aspects and advantages of the claimed subject matter will be apparent from the following description and the appended claims.

DETAILED DESCRIPTION

Figure 1:
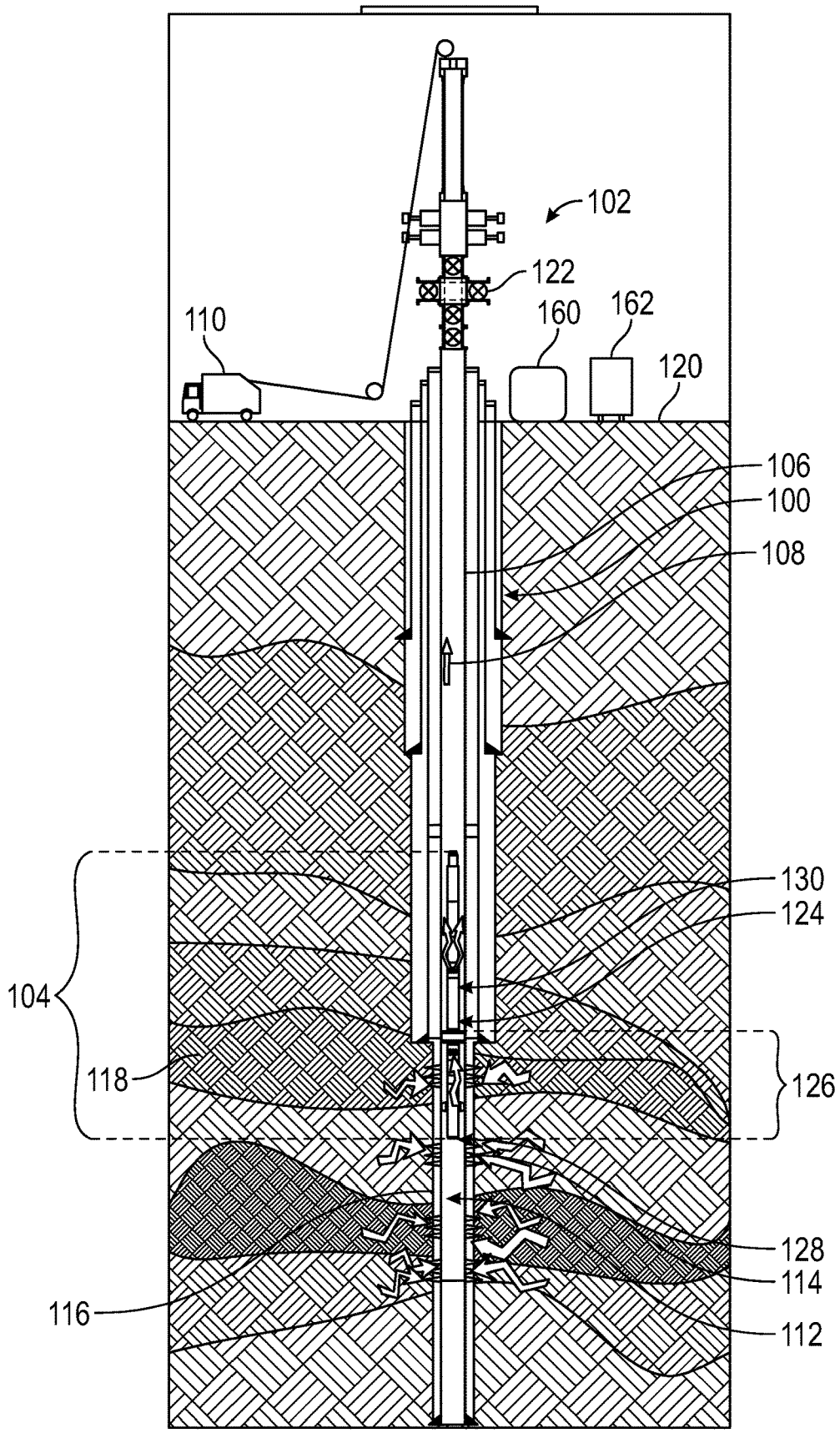
FIG. 1 shows an exemplary well with a well initiation system in accordance with one or more embodiments.

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In one aspect, embodiments disclosed herein relate to a system with a wireline bottom hole assembly (BHA) that is configured to pump fluids from an isolated intake port to an outlet port for the purpose of initiating or logging natural flow in a subterranean well. Specifically, one or more embodiments relate to a wireline conveyed electrical tool that includes a multi-resettable packer assembly within a BHA integrated with an electrical submersible pump (ESP). One or more embodiments disclosed herein provide a well-initiation service system that includes an ESP integrated within a wireline BHA that has a multi-resettable packer assembly, that is actuated by a stroker tool. The stroker tool may be an electro-hydraulic tool. Embodiments disclosed herein may provide a system and method for unloading a well. Furthermore, embodiments disclosed herein provide a well-initiation service system that includes a common power and communications bus that runs from the surface throughout the BHA and that integrates the operation of the stroker tool with downhole sensors via a surface control system.

A well that has undergone a well kill with workover fluid includes a column of heavy fluid that prevents reservoir fluid from flowing through the hydrostatic head created by the fluid column suppressing the pressure of the reservoir fluids. In order to re-initiate natural flow in a well that has undergone a well kill, a well initiation service system in accordance with one or more embodiments disclosed herein displaces the workover fluid column and reduces the hydrostatic pressure thereby unloading the well. Natural flow occurs when reservoir fluid is capable of flowing without the assistance of artificial lift.

To initiate natural flow in a well, a well initiation service system including a BHA in accordance with embodiments disclosed herein is run through the production tubing to a depth of interest on the wireline. The well initiation service system in accordance with one or more embodiments disclosed herein may be a modular combination of components including a stroker tool, a customized pump, a packer section, and a downhole drive section. In accordance with embodiments disclosed herein, the multi-resettable packer assembly is provided and may be actuated to grip an inner surface of the production tubing or casing. A stroker tool coupled to the multi-resettable packer assembly includes a piston that energizes the multi-resettable packer to create a temporary annular seal against the inner surface of the production tubing or casing. During operation, the pump of the well initiation service system pumps fluid from the formation to surface and one or more sensors measure operational parameters. As the system operates with the annular seal actuated, the pump lifts the dense fluid column out of the wellbore, which is then replaced by an influx of a less dense fluid from the formation. At the start of pumping, the differential pressure across the annular seal increases, meaning a higher pressure is above the seal than below the seal. As the dense fluid column is replaced by the less dense fluid during pumping, the differential pressure across the annular seal is lowered to or below zero, indicating natural flow solely by reservoir pressure. The sensors increase situational awareness of well production status and automation of safety systems.

The well initiation service system pumps fluids from an isolated intake port to an outlet port in the BHA. When natural flow is detected by one or more sensors, the piston of the stroker tool deenergizes the multi-resettable packer to release the annular seal in the inner surface of the production tubing or casing. This well initiation service system offers sensors that can indicate whether or not the well is unloading. The BHA may be moved or adjusted to other depths of interest in the well for continuation of packer set and unset. For horizontal well access, conveyance of wireline tools, such as the BHA, may be achieved by additional tractor modules in the tool string. Horizontal well access is possible in up to 90 degree well deviations with easily integrated tractor modules. In some embodiments, in high H2S wells, an existing H2S compliant wireline electrical cable is available to be used due to lower power requirements of the system.

FIG. 1 shows an exemplary well (100) with a well initiation system (102) in accordance with one or more embodiments. The well initiation system (102) includes a bottom hole assembly (BHA) (104) that is conveyed into production tubing (106) in the well (100) with a wireline cable (108) controlled by a wireline winch unit (110). The well initiation system (102) is used to help produce fluids (112) from a formation (118). The well (100) may include perforations (114) in the casing string (116) and/or production tubing (106) to provide a conduit for fluids (112) to enter the well (100) from the formation (118) and into the production tubing (106). The BHA (104) is deployed inside the production tubing (106) of the well (100). The production tubing (106) extends to the surface (120) and is made of a plurality of tubulars connected together to provide a conduit for fluids (112) to migrate to the surface (120). The surface (120) is any location outside of the well (100), such as the Earth's surface. Once the fluids (112) are produced to the surface (120), the fluids (112) flow through a wellhead (122). The fluids (112) may then flow into any production line or transportation, such as a pipeline or a tank.

Figure 2:
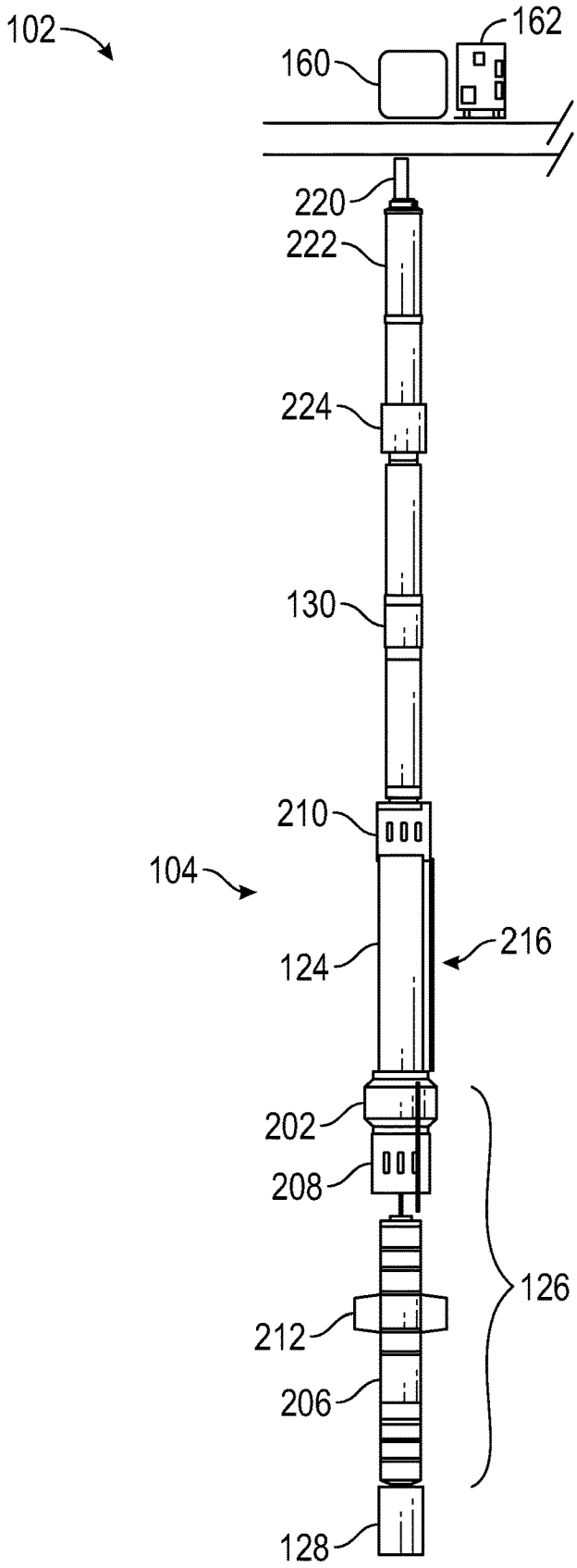
FIG. 2 shows a well initiation service system in a single packer system in accordance with one or more embodiments.

The BHA (104) includes an electrical submersible pump (ESP) (124), a multi-resettable packer assembly (126), and a sensor (128) as discussed in further detail in FIG. 2. The BHA (104) may also include various pipe segments of different lengths to connect the components of the BHA (104). The well initiation service system (102) uses a multi-resettable packer assembly (126) in the wireline BHA (104) integrated with the ESP (124) with enhanced temperature range, increased safety, and availability for use even in high H2S conditions. The ESP (124) has an outer diameter smaller than the inner diameter of the production tubing (106). For example, the ESP (124) may have an outer diameter between 2 inches and 3.6 inches rather than a typical outer diameter size of around 5.62 inches. The ESP (124) may be a positive displacement pump similar to a progressing cavity pump or other known artificial lift pumps, such as those available from Rotoliptic Technologies Incorporated (Squamish, British Columbia). A progressing cavity pump is capable of handling highly viscous fluids. The ESP (124) may be of an elastomeric or metallic stator type with multiple lobe configurations.

The BHA (104) may further include a downhole drive section (130) including a motor providing rotary power to the ESP (124). The downhole drive section (130) may be inverted, meaning positioned uphole from the ESP (124) as illustrated in FIG. 1. For example, the ESP (124) may be an orbital motion positive displacement pump. The ESP (124) may include a pump rotor shaft connected to an output shaft of the motor for the drive section (130) using a flexible shaft (not shown) to translate the non-concentric orbital motion of the motor to the ESP (124). The downhole drive section (130) may allow the ESP (124) to operate continuously and intermittently or be shut-off in the event of an operational problem.

In one or more embodiments, one or more sensors (128) may be installed in various locations along the BHA (104) to gather downhole data such as discharge pressure, fluid density, pump intake volumes and pressures, shaft speeds and positions, and temperatures.

The well initiation system (102) includes a power and communications bus (160) to power and control the BHA (104). The power and communications bus (160) may include a series of wires connecting the BHA (104) to a control system (162). The power and communications bus (160) may be integrated into the wireline cable (108) or be a separate entity. The power and communications bus (160) may be any type of device capable of passing electrical power and communication signals to downhole tools, such as in the BHA (104). For example, the power and communications bus (160) may pass electrical power and communication signals past the ESP (124) and its components, such as the pump intake, as further detailed in FIG. 2 to any equipment downhole. The control system (162) monitors operating data received by the sensor (128) and controls the power and communications bus (160). The control system (162) may be connected to any equipment or tool in the BHA (104) remotely or via a cable, such as the wireline cable (108). The control system (162) may be integrated into the wireline winch unit (110) or separate entity. The control system (162) may be located on surface (120) or be a processor situated downhole in the BHA (104) chassis. The control system (162) is configured to monitor operating data measured by one or more sensors (128) and control downhole tools, such as the stroker tool (206), explained in more detail below.

FIG. 2 shows a well initiation service system (102) including the bottom hole assembly (BHA) (201) in accordance with one or more embodiments. The BHA (104) may be conveyed to a predetermined depth in the production tubing (106). The BHA (104) may be powered and conveyed by a system using a collector power swivel and a winch drum and mechanism, such as the wireline winch unit (110) and wireline cable (108) described in FIG. 1. FIG. 2 shows an example of a BHA with a single packer system. Specifically, FIG. 2 shows one multi-resettable packer (202) in the multi-resettable packer assembly (126) of the BHA (104). The single packer system is utilized for displacing a heavy kill fluid column to be replaced by an influx of a lighter density fluid, such as produced fluid (112), from the reservoir or formation (118). The BHA (104) includes multiple components such as an ESP (124) and the multi-resettable packer assembly (126), which includes the multi-resettable packer (202).

The multi-resettable packer assembly (126) also includes a stroker tool (206), and a port sub (208). The multi-resettable packer assembly (126) may include more than one multi-resettable packer (202) to create a straddle packer configuration. The straddle packer configuration involves more than one multi-resettable packer (202) with the port sub (208) located between each multi-resettable packer (202). The multi-resettable packer (202) may be any type of packer capable of compression (and radial expansion) and decompression. The multi-resettable packer (202) may be made up of a flexible elastomeric scaling material, such as VITON 80. The multi-resettable packer (202) may be of a toroid shape.

The port sub (208) may be coupled between the multi-resettable packer (202) and the stroker tool (206). The port sub (208) may be any pipe configured to hydraulically connect the production tubing (106) to the ESP (124), such as a pump intake. The port sub (208) may allow fluids (112) to flow into the multi-resettable packer (202) from the casing string (116) or production tubing (106). The port sub (208) may connect the ESP (124) to other BHA (104) components, such as the multi-resettable packer (202). The port sub (208) may include slotted perforations (114), a sized sand screen style filter, or round holes. The port sub (208) may be designed to allow a flow of fluid (112) from the production tubing (106) into the bore of the port sub (208) and to the ESP (124) whilst excluding large particles from being ingested into the ESP (124). Fluids (112) may flow into the port sub (208) through the ESP (124) and out of a pump discharge (210). The pump discharge (210) is a section in the BHA (104) where the reservoir fluids (112) exit the BHA (104) into the production tubing (106). The pump discharge (210) may be an outlet port disposed on the ESP (124). As shown in FIG. 2, the port sub (208) may be disposed axially below the multi-resettable packer (202), while the ESP (124) is disposed axially above the multi-resettable packer (202).

The multi-resettable packer assembly (126) may include a stroker tool (206). In one or more embodiments, the stroker tool (206) is an inverted stroker such that the stroker includes a piston configured to extend upwardly from the stroker tool and retract downwardly into the stroker tool. The stroker tool (206) is designed to compress and decompress the multi-resettable packer (202) to seal and unseal, respectively, the inner surface of the production tubing (106). The stroker tool (206) includes a plurality of slips (212) configured to grip the inner surface of the production tubing (106). The slips (212) may be electrohydraulic actuator slips. The slips (212) may be any device disposed on an outer surface of the stroker tool (206) that is capable of gripping or holding the stroker tool (206) to the inner surface of the production tubing (106). The features and function of the stroker tool are described in more detail below with respect to FIG. 3

The BHA (104) includes one or more sensors (128) disposed on the end of the BHA (104) connected to the multi-resettable packer assembly (126). The one or more sensors (128) are configured to measure operating data, such as pressure measurements and fluid flow measurements. Pressure and fluid flow measurements may be measured upstream or downstream of the ESP (124). The sensor (128) may be of any type of downhole sensor as described in FIG. 1. The sensor (128) may include but is not limited to a discharge pressure sensor, density sensor, gas volume fraction (GVF) sensor, intake pressure sensor, flow sensor, etc. The sensors (128) may measure and collect operating data in real time during operations. The BHA (104) may include numerous additional components, such as a standard E-Line Cable for H2S service (220), a cable head addressable release tool (ART-H) (222), a quartz pressure and casing string (116), a discharge pressure sensor (224), a collar locator (CCL), a fluid density inertial tool, a gas hold up tool, a capacitance temperature flow, etc.

Still referring to FIG. 2, the power and communications bus (160) may include electrical wires (216) which extend in axial length around the BHA (104) and wrap around certain components of the BHA (104) and connect to the control system (162). The electrical wires (216) may be made of an electrical conductor, such as copper. The power and communications bus (160) powers and transmits signals to the BHA (104) and its components from the surface through the electrical wires (216). The power and communications bus (160) including the electrical wires (216) extends from the ESP (124) to the stroker tool (206). The electrical wires (216) may be insulated in metallic jacketed helical coils. The electrical wires (216) may be a protected channel of wired connections on the outside of the ESP (124) and through the center of the multi-resettable packer (202). Each end of the electrical wires (216) may connect with existing electrical and mechanical connections in a wireline. The electrical wires (216) may be assembled and disassembled in the well initiation service system (102) using split collars around the BHA (104), such as anti-rotation threaded split collars.

Signals from the power and communications bus (160) may be transmitted to the control system (162) for monitoring operating data sensed by the sensor (128) and transmitted to the BHA for controlling the stroker tool (206). The control system (162) may be connected to one or more components in the BHA (104) to control one or more components in the BHA (104). The control system (162) may automate the compression and decompression of the multi-resettable packer (202) based, at least in part, on the operating data measured in real time by the sensors (128). The control system (162) monitors operational data from the sensors (128) to ensure operational parameters, below the multi-resettable packer (202) are within a desired range (e.g., measure pressure to ensure pressure does not build up below multi-resettable packer (202). The power and communications bus (160) may transmit a signal at a predetermined pressure value from the control system to the BHA (104) to automatically decompress/unset the multi-resettable packer assembly (126) to allow annular flow bypass by releasing the seal.

The control system (162) may calculate a comparison of intake pressure and discharge pressure data from the ESP (124) to deduce differential pressure across the multi-resettable packer (202) in real time. The control system (162) may include an emergency component. The emergency component involves activating an emergency release command or signal at a predetermined threshold pressure value based on the differential pressure deduced by the control system (162). For example, when the predetermined threshold pressure value is exceeded, the control system (162) transmits the emergency release command to the BHA (104) to unset the multi-resettable packer (202). Additional data, such as from flow sensors, may be utilized to determine predetermined threshold values to release the seal from a set multi-resettable packer (202). Contingency features embedded in the control system (162) includes decompressing or unsetting the multi-resettable packer (202) during a well kick. A well kick involves unpredictable and extreme pressure in the well (100) that leads to fluids in the formation (118) to flow back up into the wellbore. During well kicks, the multi-resettable packer (202) is unset (decompressing the seal and disengaging the seal from the inner surface of the production tubing) while the slips (212) on the stroker tool (206) remain in contact with the production tubing (106) wall to ensure the BHA (104) does not move uphole or downhole under flow induced drag forces from the well kick.

Figure 3:
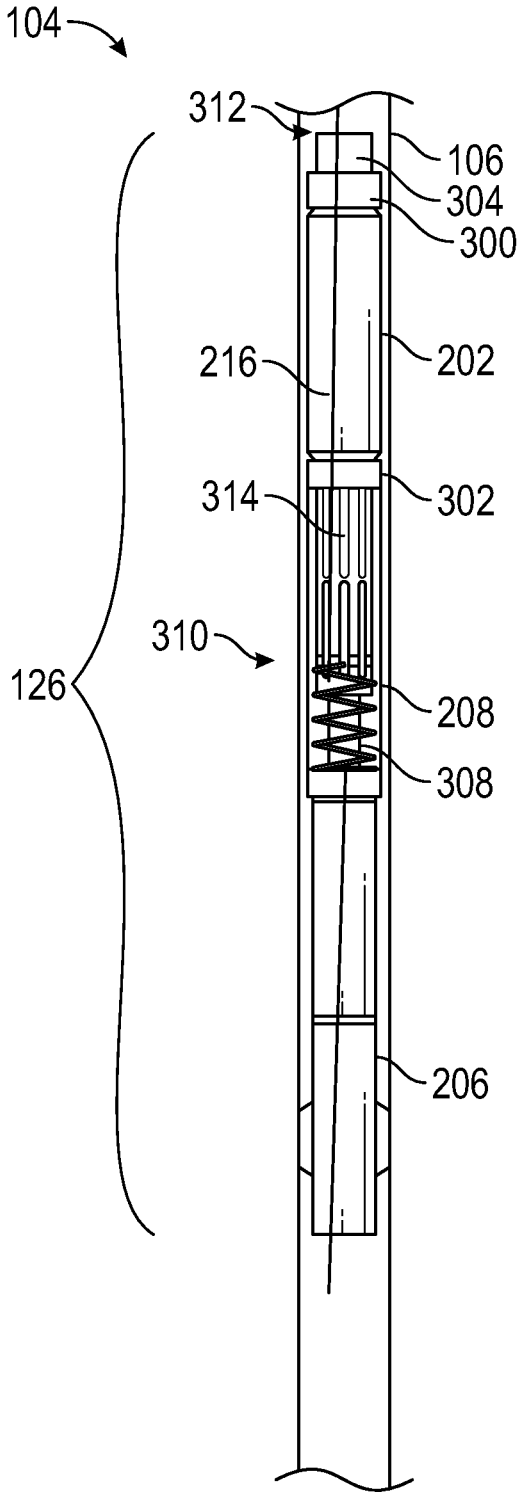
FIG. 3 shows a single packer system in an unset position in accordance with one or more embodiments.
Figure 4:
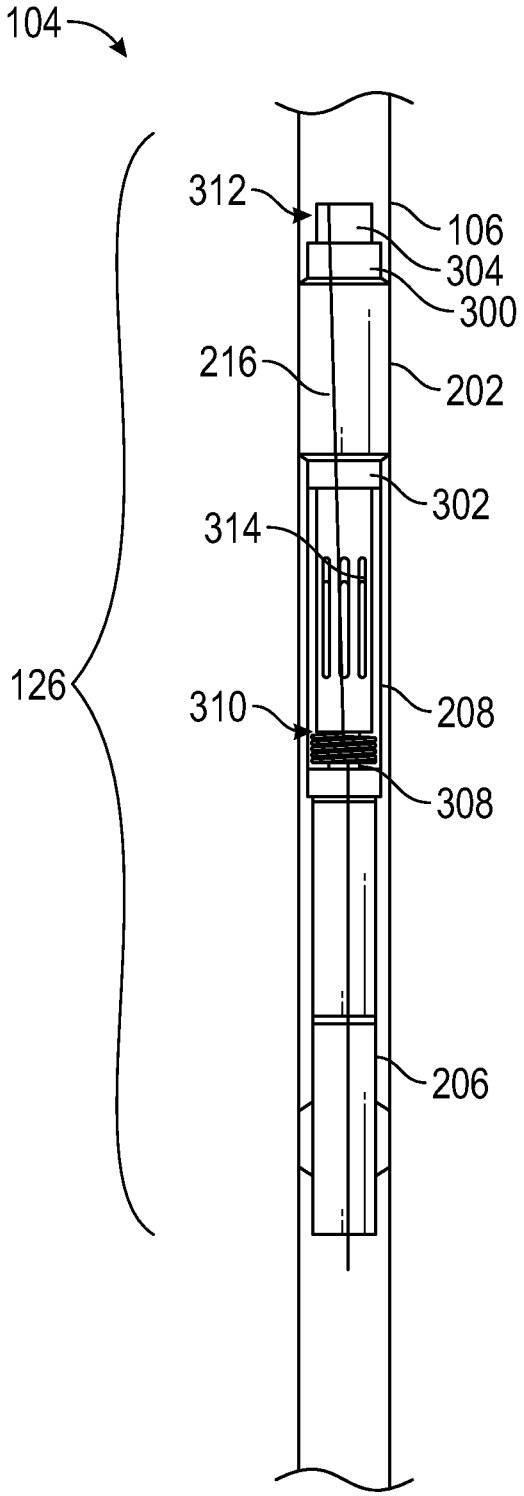
FIG. 4 shows the single packer system of FIG. 3 in a set position in accordance with one or more embodiments.

FIGS. 3 and 4 show the packer system of FIG. 2 in an unset position and a set position, respectively, in accordance with one or more embodiments. Specifically, FIG. 3 shows an unset single packer system in accordance with one or more embodiments, i.e., when the multi-resettable packer (202) is decompressed. The multi-resettable packer (202) includes an upper packer ring (300) and a lower packer ring (302). Either the upper packer ring (300) or the lower packer ring (302) may be considered a "first" packer ring and the other may be considered a "second" packer ring. The multi-resettable packer assembly (126) further includes an inner mandrel (304) and axially movable inside the port sub (208). The inner mandrel (304) may be a hollow shaft or cylindrical rod disposed inside the multi-resettable packer (202) that include one or more intake ports (314). The port sub (208) is coupled between the stroker tool (206) and the lower packer ring (302) on the multi-resettable packer (202). The port sub (208) may be a fixed hollow tube coupled between the lower packer ring (302) and the stroker tool (206). The inner mandrel (304) may extend through the multi-resettable packer (202) and into the port sub (208). The lower packer ring (302) is fixedly coupled to the port sub (208). The lower packer ring (302) includes a sliding seal disposed on an inner surface of the packer ring (302) that is configured to sealingly engage the inner mandrel (304) as it moves axially within the multi-resettable packer (202) and lower packer ring (302).

The stroker tool (206) may be an electrohydraulic tool for actuating a piston (308). The piston (308) may be a movable shaft or rod moveable axially within the stroker tool (206), such that the piston (308) is configured to extend out of the stroker tool (206) into the port sub (208) and retract into the stroker tool (206). In some embodiments, the stroker tool (206) applies a compressive axial force to the piston (308). The compressive axial force on the piston (308) will result in the piston (308) retracting into the stroker tool (206). In other embodiments, the stroker tool (206) applies a tensile axial force on the piston (308). The tensile axial force on the piston (308) will result in the piston (308) extending out of the stroker tool (206).

For example, FIG. 3 shows the piston (308) extended into the port sub (208). The inner mandrel (304) has a first end (310) and a second end (312). The first end (310) of the inner mandrel (304) is coupled to an end of the piston (308), as illustrated in FIG. 3. The second end (312) of the inner mandrel (304) is coupled to the upper packer ring (300) on the multi-resettable packer (202). The inner mandrel (304) includes at least one intake port (314) proximate to the first end (310) of the inner mandrel (304) configured to allow fluids (112) from the outside of the inner mandrel (304) to an inner bore of the inner mandrel (304), which allows fluid to flow from below the multi-resettable packer (202) to the ESP above the multi-resettable packer (202).

In the unset packer position, as shown in FIG. 3, the piston (308) is extended from the stroker tool (206) into the port sub (208). Upon extending the piston (308) (i.e., to unset the multi-resettable packer (202)), the inner mandrel (304) connected to the piston (308) moves axially through the sliding seal on the lower packer ring (302). The inner mandrel (304) moves upward from the inside of the port sub (208) through the multi-resettable packer (202). As the inner mandrel (304) moves upward, the multi-resettable packer (202) is stretched as the upper packer ring (300) moves further away from the second packer ring (302). As the upper packer ring (300) moves further away from the second packer ring (302), the multi-resettable packer (202) decreases in diameter as it stretches. The diameter of the multi-resettable packer (202) in an unset position may be a relaxed original outer diameter of the multi-resettable packer (202). The multi-resettable packer (202) decompresses and releases the seal from the inner surface of the production tubing (106). The multi-resettable packer (202) may revert to the relaxed original outer diameter when the multi-resettable packer (202) is decompressed. Decompression of the multi-resettable packer (202) disengages an outer surface of the multi-resettable packer (202) from the production tubing (106). The seal that was formed against the inner surface of the production tubing (106) is released upon decompression of the multi-resettable packer (202) to create an annular flow path through the production tubing (106).

The single packer system shown in FIGS. 3 and 4 also includes a power and communications bus (160) as described above with reference to FIG. 2. The electrical wires (216) in the power and communications bus (160) are illustrated in FIGS. 3 and 4 helically coiled around the piston (308). The electrical wires (216) travel through the inner mandrel (304), multi-resettable packer (202), and the port sub (208). The helical coil of the electrical wires (216) around the piston (308) may be compressed or stretched in axial length. The helical coil of electrical wires (216) may pass through a pipe or sub when stretching or compressing in axial length. The helical coil of the electrical wires (216) is designed to prevent disruption of the electrical wires (216) and the power and communications bus (160) during extension and retraction of the piston (308). FIG. 3 shows the helically coiled electrical wires (216) stretched in axial length around the piston (308), whereas FIG. 4 shows the helically coiled electrical wires (216) compressed in axial length around the piston (308). Alternatively, the piston (308) may include an electrical bus connection on one end with conductors embedded internally in the stroker tool (206) to accommodate the BHA (104) length change. In some embodiments, the control system (162) receives data from one or more sensor (128). Based, at least in part, on the received data, the control system (162) transmits a signal through the power and communications bus (160) and its electrical wires (216) to the BHA (104). The stroker tool (206) may extend or retract the piston (308) thereby compressing or decompressing the multi-resettable packer (202).

FIG. 4 shows the single packer system of FIG. 3 in a set position in accordance with one or more embodiments, i.e., when the multi-resettable packer (202) is compressed. As shown in FIG. 4, when the multi-resettable packer (202) is set, the piston (308) is retracted into the stroker tool (206). Retraction of the piston (308) into the stroker tool (206) moves the inner mandrel (304) axially downward further into the port sub (208). As the inner mandrel (304) moves downward into the port sub (208), the second end (312) coupled to the upper packer ring (300) moves downward respectively. Since the lower packer ring (302) with a sliding seal is coupled to the port sub (208), the inner mandrel (304) slides downward through the lower packer ring (302). The multi-resettable packer (202) compresses into the inner surface of the production tubing (106) as the upper packer ring (300) and the lower packer ring (302) move nearer to each other. The helically coiled electrical wires (216) of the power and communications bus (160) are compressed in axial length around the piston (308) when the piston is retracted in the stroker tool (206) and compressed, as illustrated in FIG. 4.

Figure 5:
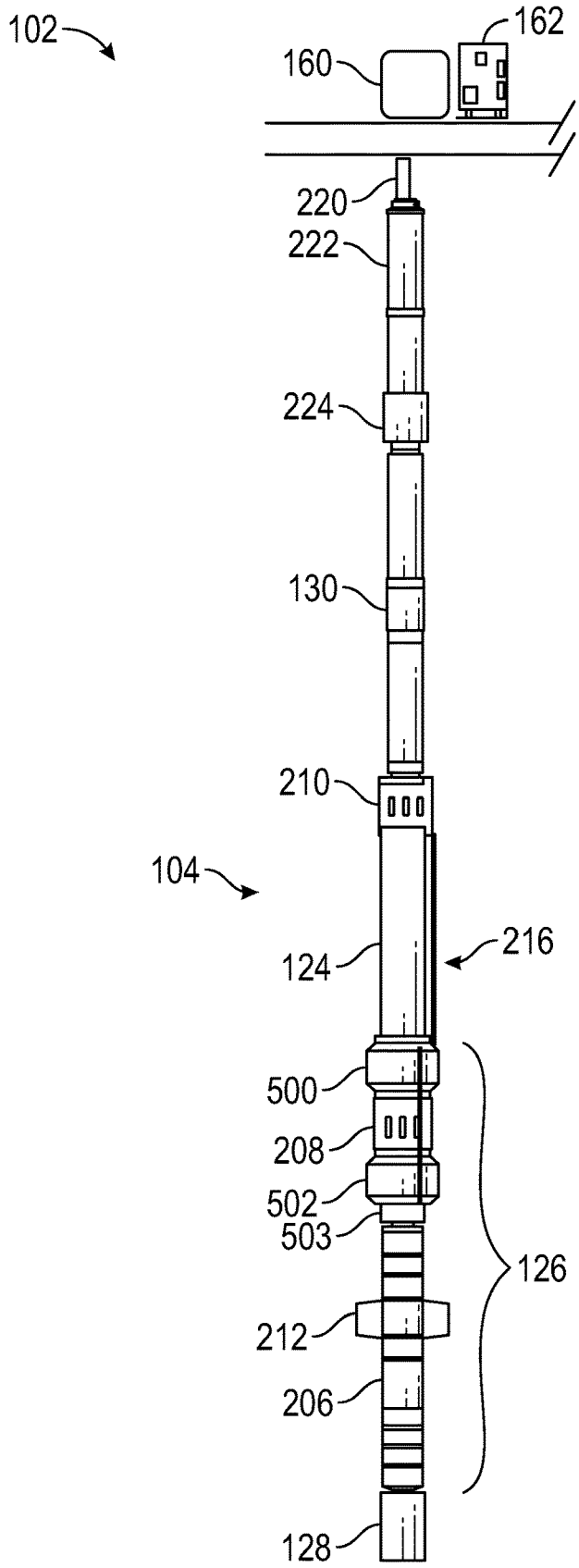
FIG. 5 shows a well initiation service system in a straddle packer system in accordance with one or more embodiments.

FIG. 5 shows the well initiations service system (102) in a straddle packer system in accordance with one or more embodiments. A straddle packer system includes more than one packer stacked (i.e., one positioned above the other) in the multi-resettable packer assembly (126) in the BHA (104). A straddle packer system may be used for pumping fluid from a limited length of production tubing (106) in a location where reservoir fluids flow into the wellbore, such as in a perforation (114) in the casing string (116) or screen section. As shown in FIG. 5, two multi-resettable packers (202) are stacked in the multi-resettable packer assembly (126). In some embodiments, a first multi-resettable packer (500) may be positioned above the port sub (208) and a second multi-resettable packer (502) may be positioned below the port sub (208). In some embodiments, as shown in FIG. 5 the first multi-resettable packer (500) is connected to a first end of the port sub (208) and the second multi-resettable packer (502) is connected to a second end of the port sub (208). The multi-resettable packers (500, 502) of straddle packer systems according to embodiments disclosed herein, may be constructed as disclosed above with respect to FIGS. 2-4 but further include an outer tube (503) disposed between the second multi-resettable packer (502) and the stroker tool (206) for the inner mandrel (304) to axially move into the outer tube (503). Further, actuation of the multi-resettable packers (500, 502), to set and/or unset the multi-resettable packers (500, 502) may be accomplished with actuation or deactuation of a stroker tool (206), as discussed with respect to embodiments shown in FIGS. 2-4. In one embodiment, a single stroker tool (206) may be used to acuate/deactuate both multi-resettable packers (500, 502) in the straddle packer system shown in FIG. 5.

A BHA (104) having the straddle packer system in accordance with embodiments disclosed herein may be used for production logging of a specific reservoir zone between the multi-resettable packers (500, 502). As an alternative to using the BHA (104) for production, the BHA (104) may also be used for matrix stimulation of a specific reservoir zone. The BHA (104) may create an artificially large pressure drawdown on a small section of formation (118) thereby removing more damage than possible under normal inflow conditions. Under large pressure drawdown, damaged solid particles may be removed from rock to restore or improve permeability in the formation (118).

Figure 6:
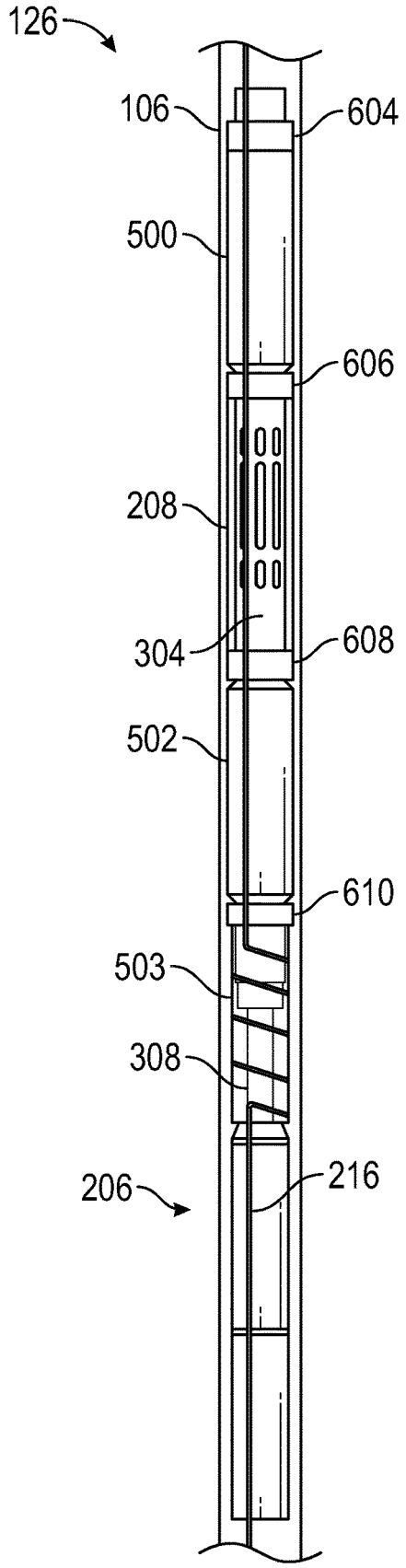
FIG. 6 shows the straddle packer system of FIG. 5 in an unset position in accordance with one or more embodiments.
Figure 7:
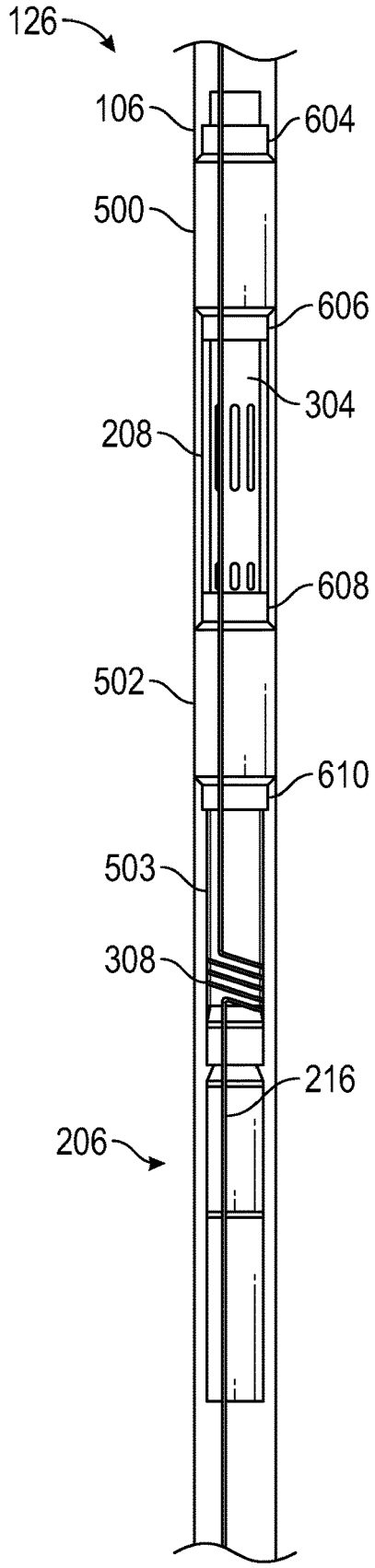
FIG. 7 shows the straddle packer system of FIG. 5 in a set position in accordance with one or more embodiments.

FIGS. 6 and 7 show a straddle packer system in an unset position and a set position, respectively, in accordance with one or more embodiments. Specifically, FIG. 6 shows an unset straddle packer system, in accordance with one or more embodiments, with the port sub (208) disposed between two multi-resettable packers (202), a first multi-resettable packer (500) and a second multi-resettable packer (502). The inner mandrel (304) is axially movable through the first multi-resettable packer (500), the port sub (208), the second multi-resettable packer (502), and the outer tube (503) such that axial movement of the inner mandrel (304) facilitates setting and unsetting the first multi-resettable packer (500) and second multi-resettable packer (502). The components of the multi-resettable packer assembly (126) are shown in FIG. 6 when the first multi-resettable packer (500) and second multi-resettable packer (502) are decompressed (unset).

As shown in FIG. 6, the first multi-resettable packer (500) includes a first upper packer ring (604) and a second upper packer ring (606) coupled to the ends of the first multi-resettable packer (500). The first upper packer ring (604) is fixedly coupled to the inner mandrel (304). The first lower packer ring (606) includes a sliding seal disposed on the inner surface of the first lower packer ring (606) that is configured to allow the inner mandrel (304) to slide through the first lower packer ring (606) while remaining stationary with the port sub (208). The second multi-resettable packer (502) includes a second upper packer ring (608) and a second lower packer ring (610) coupled to the ends of the second multi-resettable packer (502). The second upper packer ring (608) is fixedly coupled to the inner mandrel (304). The second lower packer ring (610) includes a sliding seal disposed on the inner surface of the second lower packer ring (610) that is configured to allow the inner mandrel (304) to slide through the second lower packer ring (610) while remaining stationary with the outer tube (503).

In the unset position, the piston (308) is extended out of the stroker tool (206) to apply pressure to the inner mandrel (304). The inner mandrel (304) may move axially uphole through the first multi-resettable packer (500), the second multi-resettable packer (502), and the port sub (208) through the sliding seals on the first lower packer ring (606) and the second lower packer ring (610). As the first upper packer ring (604) and the first lower packer ring (606) move further apart, the first multi-resettable packer (500) decompresses and releases the seal between the inner surface of the production tubing (106) and the first multi-resettable packer (500). As the second upper packer ring (608) and the second lower packer ring (610) move further apart, the second multi-resettable packer (502) decompresses and releases the seal between the inner surface of the production tubing (106) and the second multi-resettable packer (500). When the first multi-resettable packer (500) and the second multi-resettable packer (502) are decompressed/unset, an annular flow path in the production tubing (106) may be formed.

FIG. 7 shows the straddle packer system of FIG. 5 in a set position in accordance with one or more embodiments. The components of the multi-resettable packer assembly (126) are shown in FIG. 7 when the multi-resettable packers (202) are compressed and therefore radially expanded to seal against the production tubing (106). In one or more embodiments, a compressive axial force is applied to the piston (308) by the stroker tool (206). Retracting the piston (308) into the stroker tool (206) results in the inner mandrel (304) moving axially downhole through the first multi-resettable packer (500), the port sub (208), and the second multi-resettable packer (502) and into the outer tube (503). As the inner mandrel (304) moves axially downhole through the sliding seals on the first lower packer ring (606) and the second lower packer ring (610), the first upper packer ring (604) moves nearer to the first lower packer ring (606) and the second upper packer ring (608) moves nearer to the second lower packer ring (610). When the first upper packer ring (604) moves nearer to the first lower packer ring (606), the first multi-resettable packer (500) compresses and increases in outer diameter creating a seal between the inner surface of the production tubing (106) and the first multi-resettable packer (500). When the second upper packer ring (608) moves nearer to the second lower packer ring (610), the second multi-resettable packer (502) compresses and increases in outer diameter creating a seal between the inner surface of the production tubing (106) and the second multi-resettable packer (502).

In some embodiments, the control system (162) receives data from one or more sensors (128). Based, at least in part, on the received data, the control system (162) transmits a signal from the control system (162) through the power and communications bus (160) and its electrical wires (216) to the BHA (104). In response to the signal received from the power and communications bus (160), the stroker tool (206) is actuated to extend or retract the piston (308) thereby compressing or decompressing the multi-resettable packers (202).

Figure 8:
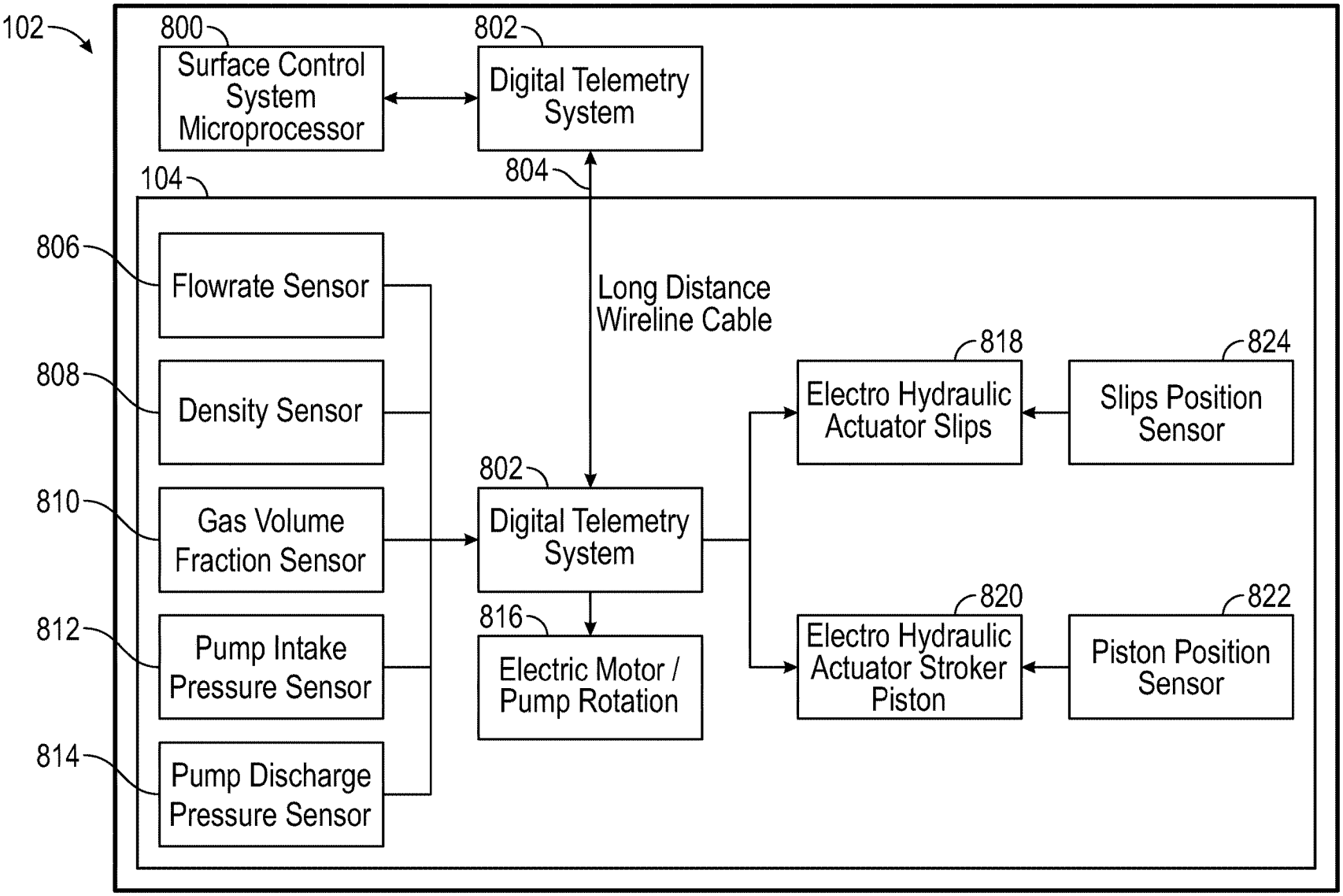
FIG. 8 shows a well initiation service system in accordance with one or more embodiments.

FIG. 8 shows a well initiation service system (102) in accordance with one or more embodiments. The control system (162) may be a surface control system microprocessor (800). The surface control system microprocessor (800) may be a human machine interface used to control power supplied to any downhole tool, such as the BHA (104). The surface control system microprocessor (800) may read and record data from sensors (128) located in the tool string or BHA (104). The surface control system microprocessor (800) may be situated in a wireline winch unit (110) or control cab on the surface (120). The surface control system microprocessor (800) communicates with a digital telemetry system (802). The digital telemetry system (802) may include the power and communications bus (160). In some embodiments, the system may include two separate digital telemetry systems (802) which communicate with each other via a long-distance wireline cable (804). The long-distance wireline cable (804) may be a braided wireline cable, such as a mono cable or hepta cable. The long-distance wireline cable (804) may include a cable head for assembly and a safety disconnect release sub. A first digital telemetry system (802) may be on surface whereas a second digital telemetry system (802) may be located downhole near or in the BHA (104). The digital telemetry system (802) may automatically collect, transmit, and measure data from sensors (128) and other devices.

For example, the BHA (104) may include sensors (128) such as a flow rate sensor (806), a density sensor (808), a gas volume fraction sensor (810), a pump intake pressure sensor (812), and a pump discharge pressure sensor (814). The sensors (128) may include additional production logging tools such as fluid density inertial tool, a gas hold up tool, a quartz pressure and casing string (116) collar locator (CCL), and a capacitance temperature flow tool. The data measured by any or all of the sensors (128) may be collected by the second digital telemetry system (802). The digital telemetry system (802) may be used to communicate with and power a motor and pump rotation (816). The digital telemetry system (802) may be used to transmit signals to slips used to anchor one or more components, such as the stroker tool (206), to the production tubing (106) including for example, electrohydraulic actuator slips (818), and the piston (308) of the stroker tool (206), such as an electrohydraulic actuator stroker piston (820). The BHA (104) may include a piston position sensor (822) which measures and communicates to the surface control system microprocessor (800) the position of the piston (308). The piston position sensor (822) may measure whether the piston (308) is retracted or extended with respect to the stroker tool (206). The BHA (104) may include a slips position sensor (824) for measuring position of the slips (212). The slips position sensor (824) may measure if the slips (212) are extended and gripping the inner surface of the production tubing (106).

Figure 9:
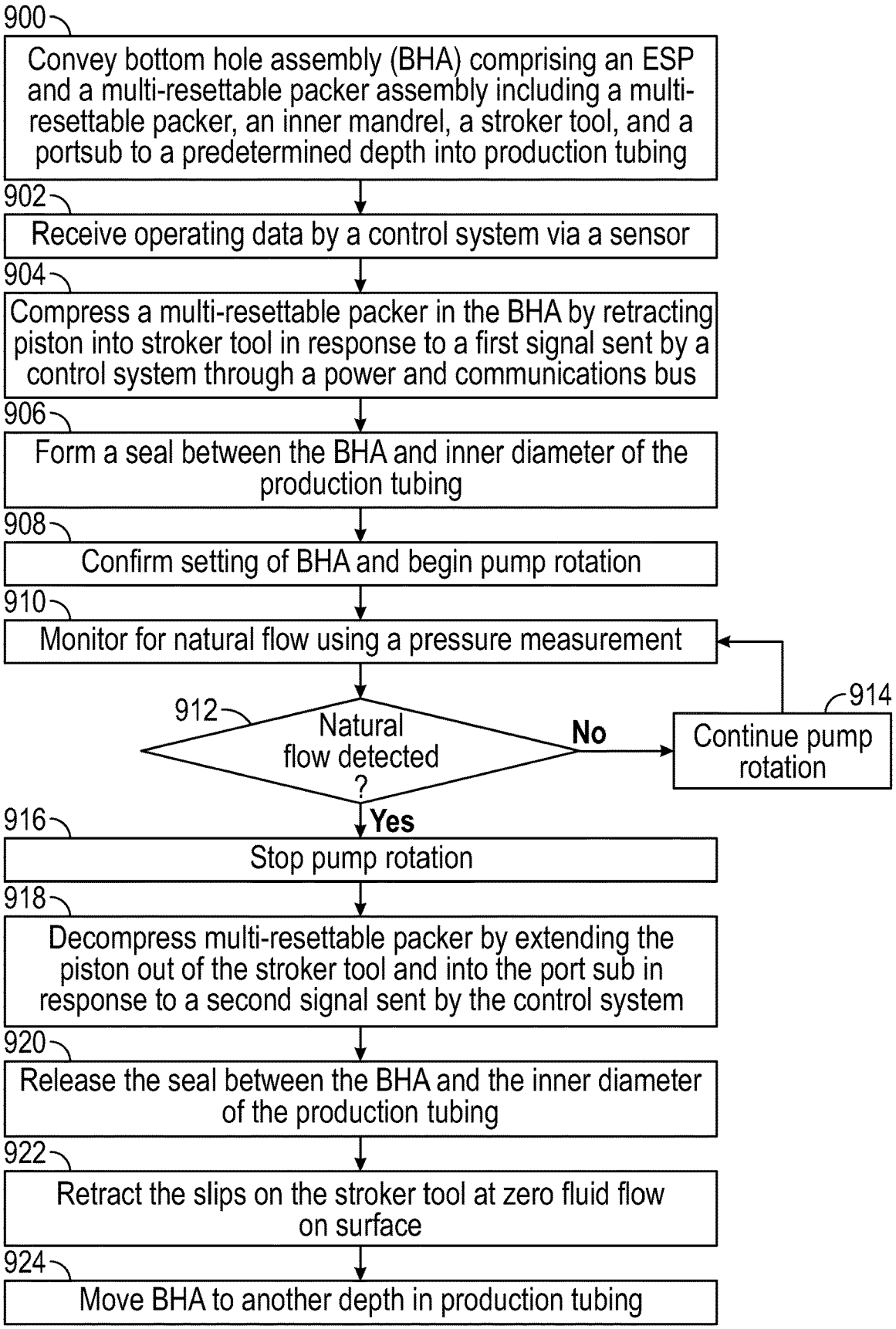
FIG. 9 shows a method flow chart in accordance with one or more embodiments.

FIG. 9 shows a flowchart of a method in accordance with one or more embodiments. Specifically, FIG. 9 describes a general method for initiating or logging natural flow in a production tubing using a system in accordance with one or more embodiments. One or more blocks in FIG. 9 may be performed by one or more components (e.g., BHA (104)) as described in FIGS. 2-8. While the various blocks in FIG. 9 are presented and described sequentially, one or ordinary skill in the art will appreciate that some or all of the blocks may be executed in different orders, may be combined or omitted, and some or all of the blocks may be executed in parallel. Furthermore, the blocks may be performed actively or passively.

Initially, in Block 900, a bottom hole assembly (BHA) comprising an ESP and a multi-resettable packer assembly including a multi-resettable packer, an inner mandrel, a stroker tool, and a port sub is conveyed to a predetermined depth into production tubing of a well. The ESP has an outer diameter smaller than the inner diameter of the production tubing. The multi-resettable packer assembly may be a single packer system with one multi-resettable packer or a straddle packer system with multiple multi-resettable packers. The stroker tool is configured to compress (and therefore expand) and decompress the multi-resettable packer to seal and unseal an inner surface of the production tubing. The stroker tool includes a plurality of slips configured to grip the inner surface of the production tubing. In some embodiments, a port sub is coupled between the stroker tool and a lower packer ring on the multi-resettable packer. The port sub is configured to hydraulically connect the production tubing to the ESP. The stroker tool includes a piston configured to extend into the port sub and retract into the stroker tool. The inner mandrel is disposed inside the multi-resettable packer and includes at least one intake port configured to allow fluid from outside the inner mandrel to an inner bore of the inner mandrel. One end of the inner mandrel is coupled to the piston and the other end of the inner mandrel is coupled to an upper packer ring on the multi-resettable packer. The inner mandrel has an outer diameter smaller than the inner diameter of the port sub. The inner mandrel moves axially into the port sub. The BHA further includes a sensor for measuring operating data including pressure measurements and fluid flow measurements.

In some embodiments, the port sub is coupled between two multi-resettable packers. In embodiments with two-multi resettable packers, an outer tube is coupled between the lower multi-resettable packer and the stroker tool. The inner mandrel may be axially movable within the first multi-resettable packer, the port sub, the second multi-resettable packer and the outer tube. The stroker tool in such embodiments extends the piston into the outer tube rather than the port sub. A wireline winch unit may be positioned in front of the well as per common rig up practice. Lower pressure control equipment may be rigged up onto a Christmas tree to control the flow produced by the well. The BHA is prepared, picked up, and installed into a wireline cable. Pressure control equipment may then be closed by making up the well. Pressure testing may be conducted to confirm integrity. The well is opened, and the BHA is run through the production tubing on the wireline. Slips on the stroker tool are activated to grip the inner surface of the production tubing or casing string.

In Block 902, operating data is received by a control system via the sensor through a power and communications bus. The power and communications bus includes a plurality of electrical wires disposed in the BHA and helically coiled around the piston. In Block 904, the multi-resettable packer in the BHA is set or compressed by retracting the piston into the stroker tool in response to a first signal sent by a control system through the power and communications bus. The inner mandrel moves axially down through a sliding seal on the lower packer ring and into the port sub. The multi-resettable packer is made of an elastomer material having a toroid shape. Compressing the multi-resettable packer may be performed at a predetermined pressure value based, at least in part, on operating data received via the sensor. Compressing the multi-resettable packer may compress the electrical wires helically coiled around the piston in the BHA to prevent interruption or damage on the electrical wires when axial movement of the piston or inner mandrel occurs. In Block 906, a seal is formed between the BHA and the inner surface of the production tubing as the compressed and radially expanded multi-resettable packer sealingly engages the inner surface of the production tubing. In Block 908, setting of the BHA is confirmed and pump rotation begins. Sensors, such as position and pressure sensors, may be integrated in the BHA to confirm the setting of the BHA and seal formation. Pumping with the ESP may commence by supplying electrical power to a motor of the ESP to rotate the ESP at a selected rotational speed. In Block 910, using real time sensors, such as pressure and flow rate, a control system monitors fluid movement and observes signs of natural flow. Natural flow is indicated when pump intake pressure is higher than discharge pressure. If natural flow is not detected by the control system, in Block 912, pump rotation is continued in Block 914 and monitoring for natural flow is continued back in Block 910. If natural flow is detected by the control system, in Block 912, pump rotation is stopped in Block 916 to stop the ESP from pumping fluid in the well.

In Block 918, the multi-resettable packer is unset or decompressed by extending the piston out of the stroker tool and into the port sub in response to a second signal sent by the control system. The inner mandrel moves into the multi-resettable packer through the sliding seal on the lower packer ring. As the inner mandrel moves axially upward, it moves, it moves the upper packer ring fixed to the inner mandrel axially upward thereby decompressing the multi-resettable packer. Decompressing the multi-resettable packer may be performed at a predetermined pressure value based, at least in part, on operating data received via the sensor. The multi-resettable packer may be decompressed manually or automatically. Decompressing the multi-resettable packer decompresses the electrical wires helically coiled around the piston. In Block 920, the seal provided by the multi-resettable packer against the production tubing (i.e., an annular seal) is released between the BHA and the inner surface of the production tubing and fluid flow from below the BHA to above the BHA around the BHA is permitted. Fluid flow measurements may be obtained and monitored by the sensors on the BHA. When fluid flow reaches zero on surface, the slips on the stroker tool are retracted in Block 922. In Block 924, the BHA may be moved to another depth in the production tubing and the steps described in Blocks 904 through 922 may be repeated. The BHA may be retrieved from the production tubing when the multi-resettable packer in unset and the slips of stroker tool are disengaged from the production tubing. In one or more embodiments, the BHA may be moved into pressure control equipment to close the well. Wellhead pressure may be bled off by removing the BHA from the pressure control equipment.

Figure 10:
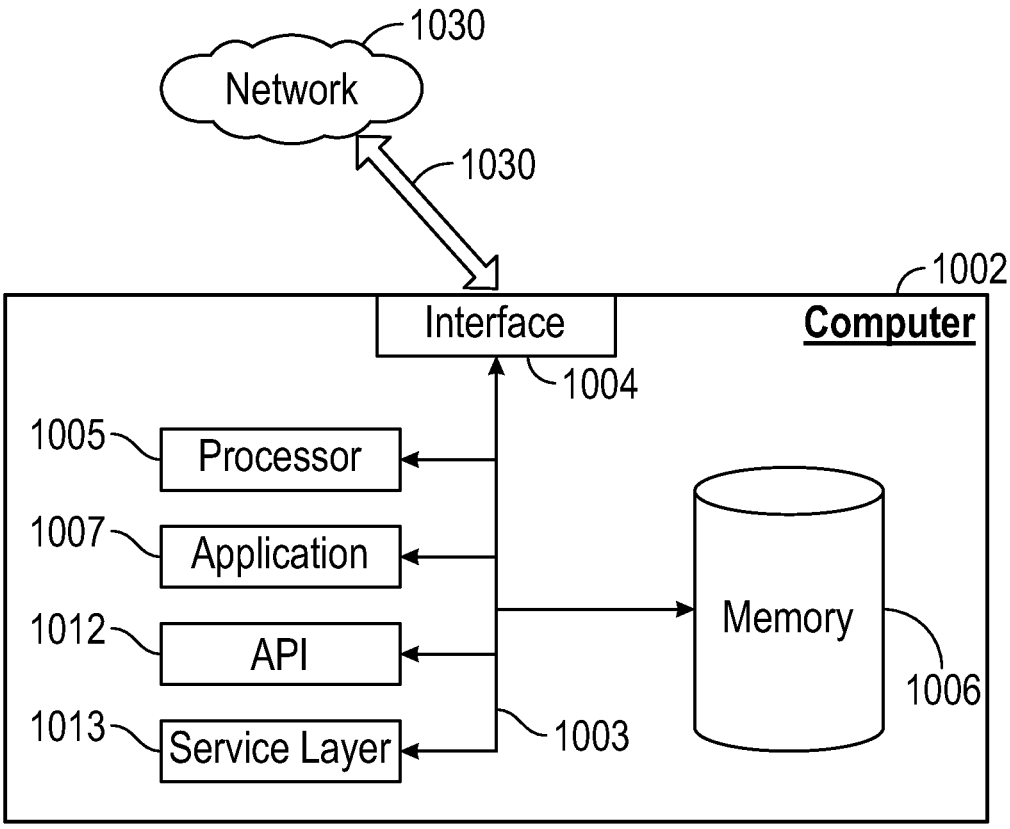
FIG. 10 shows a computer system in accordance with one or more embodiments.

Embodiments may be implemented on a computer system. FIG. 10 is a block diagram of a computer system (1002) used to provide computational functionalities associated with described algorithms, methods, functions, processes, flows, and procedures as described in the instant disclosure, according to an implementation. The illustrated computer (1002) is intended to encompass any computing device such as a high-performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (1002) may include a computer that includes an input device, such as a keypad, keyboard, touch screen, or other device that can accept user information, and an output device that conveys information associated with the operation of the computer (1002), including digital data, visual, or audio information (or a combination of information), or a GUI.

The computer (1002) can serve in a role as a client, network component, a server, a database or other persistency, or any other component (or a combination of roles) of a computer system for performing the subject matter described in the instant disclosure. The illustrated computer (1002) is communicably coupled with a network (1030). In some implementations, one or more components of the computer (1002) may be configured to operate within environments, including cloud-computing-based, local, global, or other environment (or a combination of environments).

At a high level, the computer (1002) is an electronic computing device operable to receive, transmit, process, store, or manage data and information associated with the described subject matter. According to some implementations, the computer (1002) may also include or be communicably coupled with an application server, e-mail server, web server, caching server, streaming data server, business intelligence (BI) server, or other server (or a combination of servers).

The computer (1002) can receive requests over network (1030) from a client application (for example, executing on another computer (1002)) and responding to the received requests by processing the said requests in an appropriate software application. In addition, requests may also be sent to the computer (1002) from internal users (for example, from a command console or by other appropriate access method), external or third-parties, other automated applications, as well as any other appropriate entities, individuals, systems, or computers.

Each of the components of the computer (1002) can communicate using a system bus (1003). In some implementations, any or all of the components of the computer (1002), both hardware or software (or a combination of hardware and software), may interface with each other or the interface (1004) (or a combination of both) over the system bus (1003) using an application programming interface (API) (1012) or a service layer (1013) (or a combination of the API (1012) and service layer (1013). The API (1012) may include specifications for routines, data structures, and object classes. The API (1012) may be either computer-language independent or dependent and refer to a complete interface, a single function, or even a set of APIs. The service layer (1013) provides software services to the computer (1002) or other components (whether or not illustrated) that are communicably coupled to the computer (1002). The functionality of the computer (1002) may be accessible for all service consumers using this service layer. Software services, such as those provided by the service layer (1013), provide reusable, defined business functionalities through a defined interface. For example, the interface may be software written in JAVA, C++, or other suitable language providing data in extensible markup language (XML) format or other suitable format. While illustrated as an integrated component of the computer (1002), alternative implementations may illustrate the API (1012) or the service layer (1013) as stand-alone components in relation to other components of the computer (1002) or other components (whether or not illustrated) that are communicably coupled to the computer (1002). Moreover, any or all parts of the API (1012) or the service layer (1013) may be implemented as child or sub-modules of another software module, enterprise application, or hardware module without departing from the scope of this disclosure.

The computer (1002) includes an interface (1004). Although illustrated as a single interface (1004) in FIG. 5, two or more interfaces (1004) may be used according to particular needs, desires, or particular implementations of the computer (1002). The interface (1004) is used by the computer (1002) for communicating with other systems in a distributed environment that are connected to the network (1030). Generally, the interface (1004 includes logic encoded in software or hardware (or a combination of software and hardware) and operable to communicate with the network (1030). More specifically, the interface (1004) may include software supporting one or more communication protocols associated with communications such that the network (1030) or interface's hardware is operable to communicate physical signals within and outside of the illustrated computer (1002).

The computer (1002) includes at least one computer processor (1005). Although illustrated as a single computer processor (1005) in FIG. 10, two or more processors may be used according to particular needs, desires, or particular implementations of the computer (1002). Generally, the computer processor (1005) executes instructions and manipulates data to perform the operations of the computer (1002) and any algorithms, methods, functions, processes, flows, and procedures as described in the instant disclosure.

The computer (1002) also includes a memory (1006) that holds data for the computer (1002) or other components (or a combination of both) that can be connected to the network (1030). For example, memory (1006) can be a database storing data consistent with this disclosure. Although illustrated as a single memory (1006) in FIG. 10, two or more memories may be used according to particular needs, desires, or particular implementations of the computer (1002) and the described functionality. While memory (1006) is illustrated as an integral component of the computer (1002), in alternative implementations, memory (1006) can be external to the computer (1002).

Application (1007) is an algorithmic software engine providing functionality according to particular needs, desires, or particular implementations of the computer (1002), particularly with respect to functionality described in this disclosure. For example, application (1007) can serve as one or more components, modules, applications, etc. Further, although illustrated as a single application (1007), the application (1007) may be implemented as multiple applications (1007) on the computer (1002). In addition, although illustrated as integral to the computer (1002), in alternative implementations, the application (1007) can be external to the computer (1002).

There may be any number of computers (1002) associated with, or external to, a computer system containing computer (1002), each computer (1002) communicating over network (1030). Further, the term "client," "user," and other appropriate terminology may be used interchangeably as appropriate without departing from the scope of this disclosure. Moreover, this disclosure contemplates that many users may use one computer (1002), or that one user may use multiple computers (1002).

In some embodiments, the computer (1002) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

During conventional well unloading operations, challenges are encountered including solids debris obstructing pumps, high temperatures overloading downhole equipment, and lack of downhole data. The well initiation service system (102) overcomes these challenges using the multi-resettable packer assembly (126). The well initiation service system (102) includes debris tolerant metal equipment, such as the pump, with larger operating temperature ranges than conventional operating temperature ranges. The well initiation service system (102) operates using real time downhole sensor data to increase situational awareness of well production status and automation of safety systems. The well initiation service system (102) allows an integration of tractor modules for operating in horizontal deviations in up to 90 degrees. The well initiation service system (102) has the capability to operate in high H2S wells by using existing H2S compliant wireline electric cable due to lower power requirements of the well initiation service system (102).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112 (f) for any limitations of any of the claims herein, except for those in which the claim expressly uses the words 'means for' together with an associated function.

What is claimed:

1. A bottom hole assembly (BHA) deployable in a production tubing, the BHA comprising:

an electrical submersible pump (ESP) having an outer diameter smaller than an inner diameter of the production tubing; and a multi-resettable packer assembly, the multi-resettable packer assembly comprising:

a first multi-resettable packer having a first packer ring and a second packer ring;

a port sub coupled below the first packer ring on the first multi-resettable packer, wherein the port sub is configured to hydraulically connect the production tubing to the ESP;

an inner mandrel disposed inside the first multi-resettable packer and axially movable within the first multi-resettable packer and the port sub, the inner mandrel having a first end and a second end, the second end coupled to the second packer ring on the first multi-resettable packer, the inner mandrel having at least one intake port proximate the first end configured to allow fluid from outside the inner mandrel to an inner bore of the inner mandrel; and a stroker tool configured to compress and decompress the first multi-resettable packer to seal and unseal, respectively, against an inner surface of the production tubing, the stroker tool comprising a plurality of slips configured to grip the inner surface and a piston configured to extend from and retract into the stroker tool, wherein an end of the piston is coupled to the first end of the inner mandrel.

2. The BHA of claim 1, further comprising:

a sensor disposed on the BHA configured to measure operating data, the operating data comprising a pressure measurement.

3. The BHA of claim 2, wherein the operating data further comprises a fluid flow measurement.

4. The BHA of claim 1, wherein the multi-resettable packer assembly further comprises a second multi-resettable packer having a third packer ring coupled to the port sub and the inner mandrel and a fourth packer ring; and an outer tube coupled to the stroker tool and the fourth packer ring, the stroker tool configured to compress and decompress the second multi-resettable packer to seal and unseal, respectively, against the inner surface, wherein the inner mandrel is axially movable within the second multi-resettable packer and the outer tube.

5. The BHA of claim 1, wherein the first packer ring comprises a sliding seal on the inner mandrel.

6. A system for initiating or logging natural flow in a production tubing, the system comprising:

a bottom hole assembly (BHA) disposed in the production tubing, the BHA comprising:

an electrical submersible pump (ESP) having an outer diameter smaller than an inner diameter of the production tubing; and a multi-resettable packer assembly coupled to the ESP, the multi-resettable packer assembly comprising:

a first multi-resettable packer having a first packer ring and a second packer ring;

a port sub coupled below the first packer ring on the first multi-resettable packer, wherein the port sub is configured to hydraulically connect the production tubing to the ESP;

an inner mandrel disposed inside the first multi-resettable packer and axially movable within the first multi-resettable packer and the port sub, the inner mandrel having a first end and a second end, the second end coupled to the second packer ring on the first multi-resettable packer, the inner mandrel having at least one intake port proximate the first end configured to allow fluid from outside the inner mandrel to an inner bore of the inner mandrel; and a stroker tool configured to compress and decompress the first multi-resettable packer to seal and unseal, respectively, against an inner surface of the production tubing, the stroker tool comprising a plurality of slips configured to grip the inner surface and a piston configured to extend from and retract into the stroker tool, wherein an end of the piston is coupled to the first end of the inner mandrel; and a sensor disposed on the BHA configured to measure operating data, the operating data comprising a pressure measurement;

a power and communications bus configured to power and transmit a signal to the BHA, the power and communications bus extending from the ESP to the stroker tool; and a control system configured to monitor the operating data measured by the sensor and control the stroker tool via the power and communications bus.

7. The system of claim 6, wherein the operating data comprises a fluid flow measurement.

8. The system of claim 6, wherein the power and communications bus comprises a plurality of electrical wires disposed in the BHA and helically coiled around the piston.

9. The system of claim 6, wherein the power and communications bus transmits a signal at a predetermined pressure value of the pressure measurement, wherein the predetermined pressure value is based, at least in part, on operating data received from the sensor.

10. The system of claim 6, wherein the multi-resettable packer assembly further comprises a second multi-resettable packer having a third packer ring coupled to the port sub and the inner mandrel and a fourth packer ring; and an outer tube, coupled to the stroker tool and the further packer ring, the stroker tool configured to compress and decompress the second multi-resettable packer to seal and unseal, respectively, against the inner surface, wherein the inner mandrel is axially movable within the second multi-resettable packer and the outer tube.

11. The system of claim 6, wherein the first packer ring comprises a sliding seal on the inner mandrel.

12. A method for initiating or logging natural flow in a production tubing, the method comprising:

conveying a bottom hole assembly (BHA) on a wireline to a predetermined depth into the production tubing, the BHA comprising:

an electrical submersible pump (ESP) having an outer diameter smaller than an inner diameter of the production tubing; and a multi-resettable packer assembly, the multi-resettable packer assembly comprising:

a first multi-resettable packer having a first packer ring and a second packer ring;

a port sub coupled below the first packer ring on the first multi-resettable packer, wherein the port sub is configured to hydraulically connect the production tubing to the ESP;

an inner mandrel disposed inside the first multi-resettable packer and axially movable within the first multi-resettable packer and the port sub, the inner mandrel having a first end and a second end, the second end coupled to the second packer ring on the first multi-resettable packer, the inner mandrel having at least one intake port proximate the first end configured to allow fluid from outside the inner mandrel to an inner bore of the inner mandrel; and a stroker tool configured to compress and decompress the first multi-resettable packer to seal and unseal, respectively, against an inner surface of the production tubing, the stroker tool comprising a plurality of slips configured to grip the inner surface and a piston configured to extend from and retract into the stroker tool, wherein an end of the piston is coupled to the first end of the inner mandrel; and receiving operating data by a control system via a sensor disposed on the BHA configured to measure operating data, the operating data comprising a pressure measurement;

compressing the first multi-resettable packer by retracting the piston into the stroker tool in response to a first signal sent by the control system based, at least in part, on the received operating data through a power and communications bus configured to power and transmit the first signal to the BHA, the compressing the first multi-resettable packer comprising forming a seal between the BHA and the inner surface of the production tubing; and decompressing the first multi-resettable packer by extending the piston out of the stroker tool and into the port sub in response to a second signal sent by the control system based, at least in part, on the received operating data, the decompressing the first multi-resettable packer comprising releasing the seal between the BHA and the inner surface of the production tubing.

13. The method of claim 12, further comprising;

retrieving the BHA from the production tubing based, at least in part, on the fluid flow measurement upon decompressing the multi-resettable packer.

14. The method of claim 12, wherein:

the compressing the first multi-resettable packer is performed at a first predetermined pressure value of the pressure measurement; and the decompressing the first multi-resettable packer is performed at a second predetermined pressure value of the pressure measurement, wherein the first predetermined pressure value and the second predetermined pressure value are based, at least in part, on operating data received via the sensor.

15. The method of claim 12, wherein receiving operating data comprises obtaining a flow rate measurement.

16. The method of claim 12, wherein compressing the first multi-resettable packer compresses a plurality of electrical wires helically coiled around the piston in the BHA, wherein the power and communications bus comprises the plurality of electrical wires.

17. The method of claim 16, wherein decompressing the first multi-resettable packer decompresses the plurality of electrical wires helically coiled around the piston in the BHA, wherein the power and communications bus comprises the plurality of electrical wires.

18. The method of claim 12, wherein compressing the first multi-resettable packer includes moving the inner mandrel into the port sub through a sliding seal on the first packer ring, and wherein decompressing the first multi-resettable packer includes moving the inner mandrel into the first multi-resettable packer through the sliding seal.

19. The method of claim 12, further comprising:

compressing a second multi-resettable packer of the multi-resettable packer assembly by retracting the piston into the stroker tool, the compressing the second multi-resettable packer comprising forming a second seal between the BHA and the inner surface of the production tubing, the compressing comprising axially moving the inner mandrel within the second multi-resettable packer and the outer tube; and coupling a third packer ring disposed on the second multi-resettable packer to the port sub and a fourth packer ring disposed on the second multi-resettable packer to the inner mandrel and an outer tube, the outer tube coupled to the stroker tool.

20. The method of claim 12, further comprising:

decompressing the second multi-resettable packer by extending the piston out of the stroker tool and into the port sub and the outer tube, the decompressing the second multi-resettable packer comprising releasing the second seal between the BHA and the inner surface of the production tubing.

* * * * *